US007353871B2

(12) United States Patent
Hromas et al.

(10) Patent No.: US 7,353,871 B2
(45) Date of Patent: Apr. 8, 2008

(54) DOWNHOLE AUTOMATIC TOOL RELEASE AND METHOD OF USE

(75) Inventors: Joe C. Hromas, Sugar Land, TX (US); Larry Grigar, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 305 days.

(21) Appl. No.: 11/162,303

(22) Filed: Sep. 6, 2005

(65) Prior Publication Data

US 2006/0048940 A1 Mar. 9, 2006

Related U.S. Application Data

(60) Provisional application No. 60/522,253, filed on Sep. 7, 2004.

(51) Int. Cl.

| | |
|---|---|
| ***E21B 23/04*** | (2006.01) |
| *E21B 29/10* | (2006.01) |
| *E21B 43/117* | (2006.01) |
| *E21B 17/06* | (2006.01) |

(52) U.S. Cl. ..... 166/297; 166/55.1; 166/242.6; 166/242.7; 166/377

(58) Field of Classification Search ..... 166/371, 166/297, 55.1, 377, 242.6, 242.7
See application file for complete search history.

(56) References Cited

U.S. PATENT DOCUMENTS 3,610,335 A * 10/1971 Smith ..... 166/55.1
3,797,591 A * 3/1974 Berryman ..... 175/296
4,067,388 A * 1/1978 Mouret et al. ..... 166/208
4,526,233 A * 7/1985 Stout ..... 166/377
4,576,233 A 3/1986 George
4,579,174 A * 4/1986 Barrington ..... 166/64
4,669,539 A * 6/1987 Barrington ..... 166/120
4,756,363 A * 7/1988 Lanmon et al. ..... 166/55.1
4,776,393 A 10/1988 Forehand et al.
4,817,723 A * 4/1989 Ringgenberg ..... 166/321
5,133,412 A * 7/1992 Coronado ..... 166/381
5,228,519 A * 7/1993 Coronado et al. ..... 166/387
5,236,035 A * 8/1993 Brisco et al. ..... 166/70
5,293,940 A * 3/1994 Hromas et al. ..... 166/297
5,297,634 A * 3/1994 Loughlin ..... 166/387
5,366,014 A 11/1994 George
5,490,563 A 2/1996 Wesson et al.
5,509,481 A * 4/1996 Huber et al. ..... 166/297
5,513,703 A 5/1996 Mills et al.

(Continued)

*Primary Examiner*—David V Bruce
*Assistant Examiner*—John M Deboer
(74) *Attorney, Agent, or Firm*—Bryan P. Galloway; Kevin B. McGoff; Henry L. Ehrlich

(57) ABSTRACT

A release tool adapted to be connected between a perforating gun and a tubing for releasing the perforating gun from the tubing after detonation of the perforating gun, the tool including a housing in connection with the tubing, the housing having an axial bore; an axially shiftable member in connection between the housing and a perforating gun; a seal member positioned in the axial bore of the housing, the axially shiftable member positioned through the seal member; a frangible member maintaining the axially shiftable member in connection between the housing and the perforating gun until the frangible member is shatter disconnecting the shiftable member; and a mechanism for equalizing the pressure across the seal member after the axially shiftable member is disconnected allowing the perforating gun to separate from the housing.

4 Claims, 4 Drawing Sheets

U.S. PATENT DOCUMENTS 5,778,979 A 7/1998 Burleson et al.
6,098,716 A 8/2000 Hromas et al.
6,182,750 B1 * 2/2001 Edwards et al. ..... 166/55.1
6,202,745 B1 * 3/2001 Reimert et al. ..... 166/115
2003/0192696 A1 10/2003 Myers, Jr. et al.

* cited by examiner

DOWNHOLE AUTOMATIC TOOL RELEASE AND METHOD OF USE

The present application claims benefit of U.S. Provisional Application Ser. No. 60/522,253, filed Sep. 7, 2004.

BACKGROUND OF THE INVENTION

1. Technical Field

The present invention relates generally to hydrocarbon well operations and equipment, and more particularly to a releasable connector assembly for a perforating gun and method of use.

2. Background

It is often desirable to automatically disconnect a tool from a string in a well after completion of a particular operation. For example, once a perforating gun suspended in a wellbore on a conveyor line (e.g., wireline, tubing, jointed tubing, coiled tubing, or slickline) has been detonated to achieve perforation of a target well zone, it may be advantageous for the perforating gun to automatically disconnect from the conveyor line. This is especially true in permanent completions where no additional conveyor line runs are desired. The automatic disconnection of the perforating gun from the conveyor line may be desirable because in certain formations, an inflow of formation fluids follows detonation and may cause the perforating gun to "sand up" and become stuck in the casing. Many such automatic releases are available from various manufacturers. A difficulty with some of these conventional automatic releases is that the perforating gun typically falls to the bottom of the well after detonation, and thus, the perforating gun is not recoverable.

To address this problem, some perforating gun strings may include modular perforating gun sections that automatically disconnect in a manner that allow the sections to be retrieved from the well after detonation. However, a problem with this approach is that the detonation of downhole explosives and/or the in-rush of well fluid may propel the disconnected sections up the wellbore and damage or "blow up" the well. Moreover, some existing gun release systems may not be useable in closed tubing applications where the pressure within the tubing string is less than the pressure in the wellbore.

Thus, there exists a continuing need for a perforating system having sections that automatically disconnect after detonation and yet do not pose a great danger to the well after disconnection.

SUMMARY

Generally, in one embodiment of the invention, an apparatus for releasably coupling a perforating gun to a tubing string includes a latching mechanism to couple the perforating gun to the string. The latching mechanism connects the perforating gun to the tubular member before detonation of the perforating gun. In response to the detonation of the perforating gun, the latch automatically disconnects the perforating gun from the tubular member after the expiration of a duration of time.

In another embodiment, the apparatus further includes a balancing assembly to substantially balance the pressure forces inside the tubing with the pressure forces in the wellbore. This is particularly significant when tubing pressure is less than wellbore pressure. This embodiment may further include a sealing assembly to seal the tubing from the wellbore.

Another embodiment of the present invention include a method for connecting a perforating gun to a string, detonating the perforating gun, and disconnecting the perforating gun from the string in response to the detonation. In some embodiments, the method includes equalizing the pressure within the tubing with the pressure outside the tubing such that the weight of the perforating gun causes the perforating gun to release from the tubing string.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Some prior gun release tools have proved to instantly and reliably drop off perforating gun strings at very high deviations. For example, a prior art gun release sub may be run on new wells where a ported sub is incorporated above the release sub; therefore, the tubing pressure and the rathole pressure are equalized. However, for operations requiring the tubing to be closed and sealed against rathole pressure, an upward force is created by the differential pressure against the seal diameter in the release housing of the release sub. If the tubing pressure is substantially less than the rathole pressure and gun weight (deviation reduces the gun weight) is insufficient to overcome the differential pressure force, the tool will not drop the guns. In this case, the release sub acts like a plug in the end of the tubing. Even though the guns can be detonated, if the release sub does not drop off, hydrocarbons may not flow up in the tubing to surface. The focus of the proposed invention is an automatic gun drop tool that is pressure/force balanced to pressure differentials between rathole and tubing, therefore allowing the gun string to drop.

Figure 1:
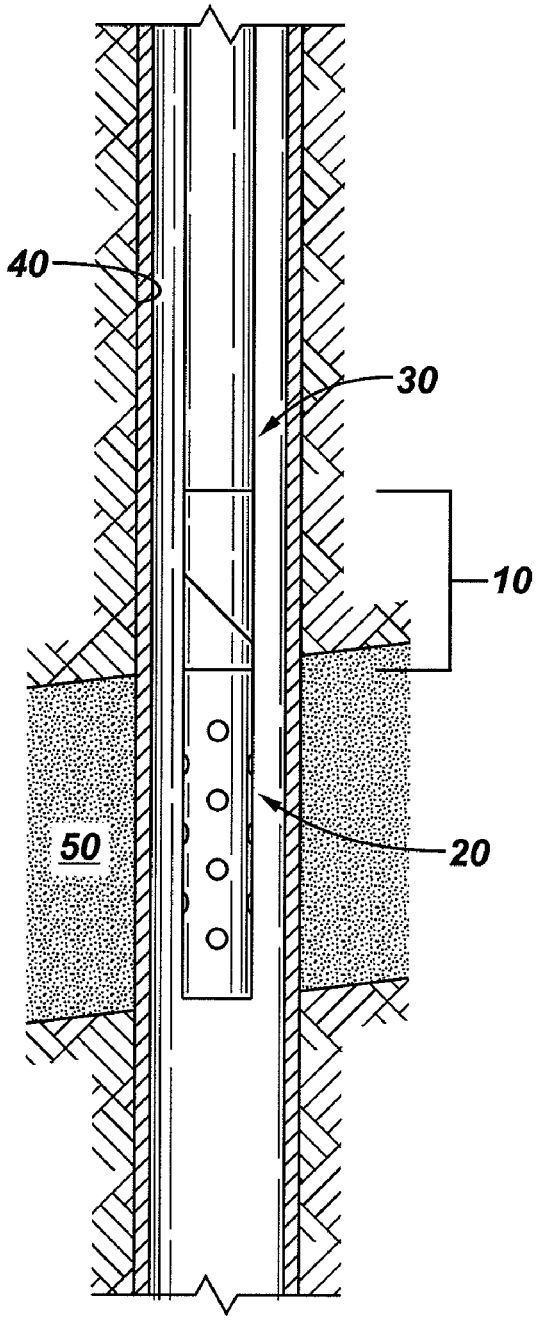
FIG. 1 illustrates a profile view of a gun system being deployed in a wellbore, the gun system being coupled to a tubing by an embodiment of a connector assembly of the present invention.
Figure 2:
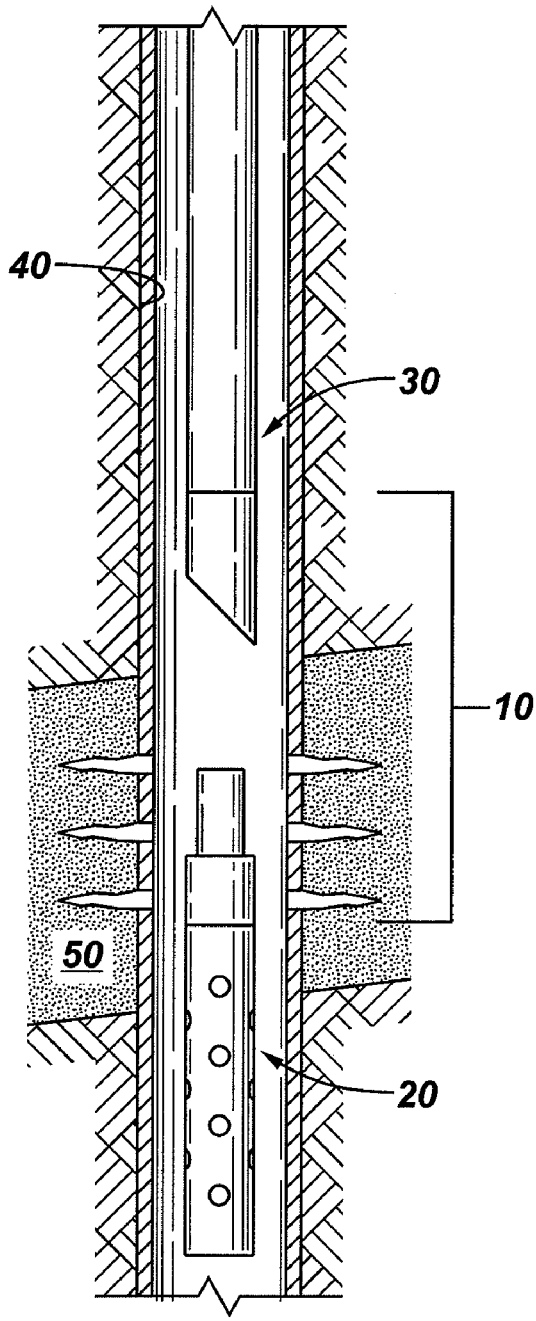
FIG. 2 illustrates a profile view of the gun system of FIG. 1 being disconnected from a tubing in a wellbore.

Generally, with reference to FIGS. 1 and 2, an embodiment of the present invention includes a connector assembly 10 for coupling a perforating gun 20 (or other completion tool actuated by a detonation such as a tubing cutter) to a tubing string 30 (or other downhole string such as a tool string) suspended in a wellbore 40. The connector assembly 10 includes: (1) a latching mechanism for releasing the gun 20 from the tubing string 30 when the gun is detonated; and (2) an equalizing mechanism for equalizing the pressure between the inside of the tubing 30 and the wellbore 40 such that the gun 20 may release from the tubing in closed tubing applications (e.g., where the pressure inside the tubing may be less than the pressure outside of the tubing). FIG. 1 illustrates the perforating gun 20 being coupled to the tubing string 30 via the connector assembly 10. FIG. 2 illustrates the perforating gun 20 being released from the tubing string 30 post-detonation.

In operation, the perforating gun 20 is fixedly secured to the connector assembly 10 and the gun is run downhole on the tubing string 30 to a target formation interval 50 of a wellbore 40. At this target formation interval 50, the perforating gun 20 is detonated. When the perforating gun 20 detonates, the latching mechanism of the connector assembly 10 automatically disconnects (immediately or after a duration of time, as described below) the perforating gun by releasing the latch's hold on the tubular string 30. In alternative embodiments, a plurality of perforating guns may be connected to a tubing string via a plurality of connector assemblies arranged in series whereby the guns are detonated. In other embodiments, the perforating gun section 20 may be retrieved after the perforating gun detonates. In these embodiments, the perforating gun may be of sufficiently short length (e.g., 40 feet) to allow the perforating gun to be retrieved into a riser of a well without killing the well.

Various embodiments of the connector assembly of the present invention include a latching mechanism and an equalizing mechanism. Embodiments of such a latching mechanism are described in U.S. Pat. No. 5,293,940, which is incorporated herein by reference.

Figure 3:
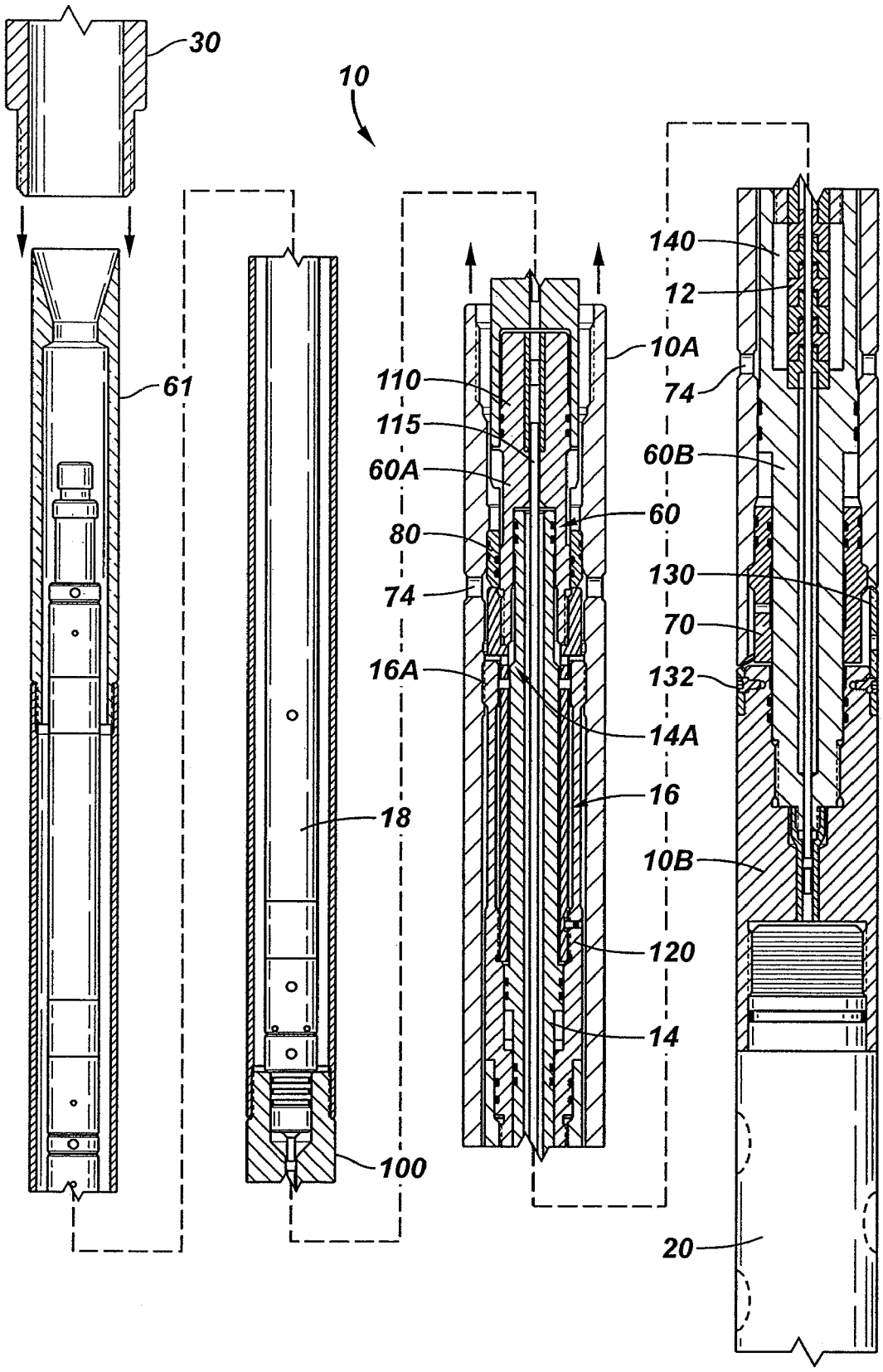
FIG. 3 illustrates a cross-sectional view of an embodiment of a connector assembly for use in releasably connecting a perforating gun to a tubing.

With respect to FIG. 3, in one embodiment of the connector assembly 10, a release housing 10A is adapted to be connected to a tubing 30. A first sub or fill sub 61 having at least one firing head 18 arranged therein is connected to a latching mechanism releasably engaging the housing 10A. The latching mechanism (including a frangible breakup plug 12, a release piston 14, and collet fingers 16) is adapted to be disposed within the release housing 10A and is connected to a second sub 10B. The second sub 10B is adapted to be connected to a perforating gun 20. In operation, when a detonation wave from the firing head 18 passes through the frangible breakup plug 12, the frangible breakup plug shatters; and, when the breakup plug shatters, the release piston 14 moves down and the latching mechanism disconnects the second sub 10B (including the attached perforating gun 20) from the release housing 10A and allows the perforating gun 20, second sub 10B, release piston 14, collet fingers 16 and fill sub 61 and firing head 18 to withdraw from within the release housing 10A and away from the tubing 30.

Figure 4C:
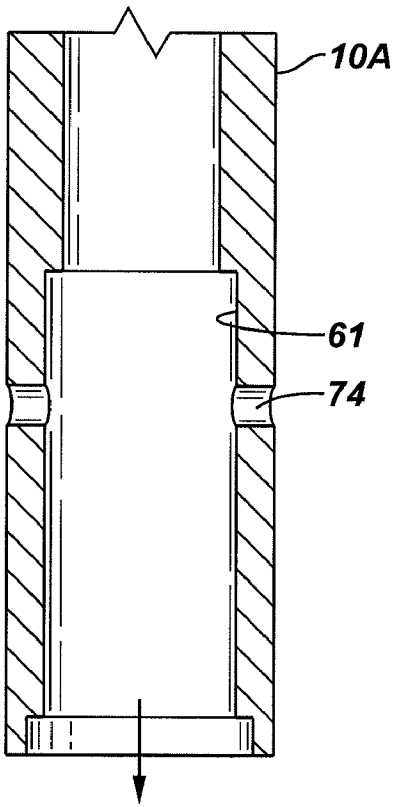
FIGS. 4A-4C illustrate an embodiment of the equalizing mechanism in accordance with the present invention.
Figure 4B:
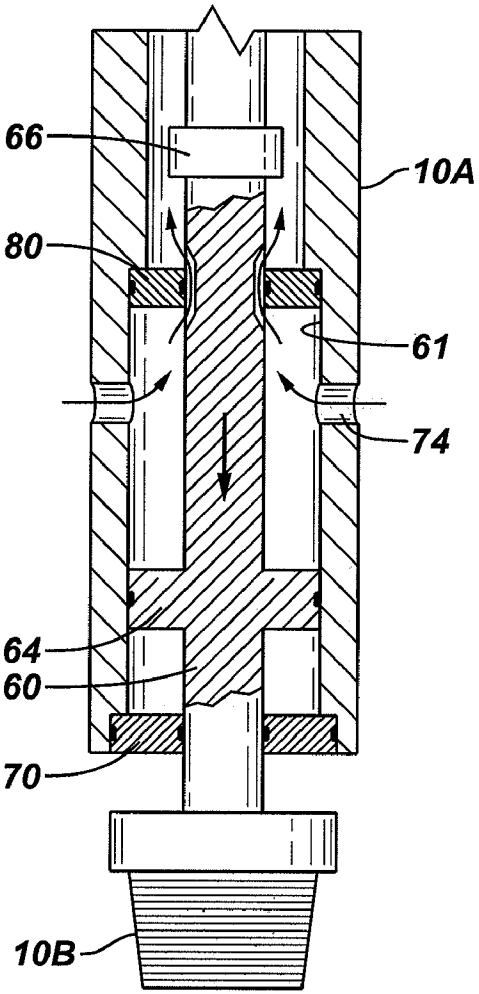
Figure 4A:
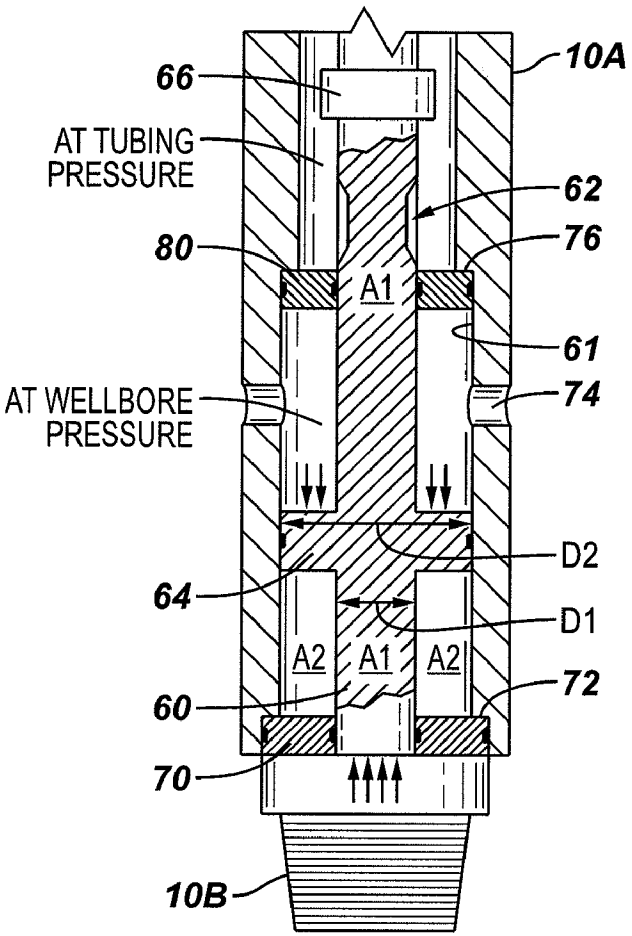

FIG. 4A illustrates an embodiment of the equalizing (or pressure balancing) mechanism of the connector assembly 10. The equalizing mechanism includes a balance mandrel 60, a lower piston 70, and an upper seal sleeve 80. The lower section of the balance mandrel 60 is connected to the second sub 10B (e.g., a perforating gun adapter) and includes a seal diameter D1 for sealing with the lower piston 70 and a larger seal diameter D2 for sealing inside a release housing 10A. The release housing 10A defines an axial bore therein. The gun adapter 10B is butted up against the lower piston 70, which is butted up to a shoulder 72 inside the release housing 10A and seals with the axial bore of the release housing. The upper end of the balance mandrel 60 includes a larger seal diameter D2, which also seals inside the release housing 10A and opposite of the lower piston 70. The annular gap between the larger seal diameter D2 and the smaller seal diameter D1 on the balance mandrel 60 defines an area A1 against an air chamber (or other low pressure/compressible fluid chamber), which is approximately equal to the area defined by the smaller diameter D1 of the balance mandrel 60. Fluid holes 74 in the release housing 10A expose the volume inside the release housing to the wellbore and allow wellbore fluid pressure to act against the annular area A2. Therefore, the pressure force up against the area A1 is equal to the pressure force against the area A2, which balances the connector assembly (assuming that the pressure in the sealed off tubing is equal to zero). The internal seal diameter of the upper seal sleeve 80, which seals off the wellbore pressure from the tubing pressure, is the same area A1 as on the balance mandrel 60. The upper seal sleeve 80 butts up to another shoulder 76 within the release housing 10A and seals inside the release housing. Thus, wellbore fluid pressure cannot push the upper seal sleeve 80 upward. As shown in FIGS. 4B-C, if the tubing pressure is greater than zero (e.g., the weight of the gun), an additional downward force is created to aid pushing the balance mandrel 60 out of the release housing 10A. As the balance mandrel 60 disengages from the release housing 10A, the lower piston 70 and upper seal sleeve 80 are displaced by elements 64 and 66 on the balance mandrel 60, respectively, to facilitate full release of the gun adapter 10B (and perforating gun). In some embodiments, the elements 64, 66 have a cross-sectional diameter larger than the diameter of the balance mandrel 60 but equal to or smaller than the diameter of the bore of the release housing 10A below the upper seal sleeve 80.

Still with respect to FIGS. 4A-4C, in some embodiments, the balance mandrel 60 includes one or more equalizing grooves or slots 62 formed in the upper balance section 60A for balancing the tubing pressure with the wellbore pressure. Initially, the slots 62 are positioned above the upper seal sleeve 80 (as shown in FIG. 4A). As the balance mandrel 60 begins to move axially downward, the slots 62 uncover the inner seal of the upper seal sleeve 80 (as shown in FIG. 4B). This allows the tubing pressure to balance with the wellbore pressure thus facilitating the gun adapter 10B to drop out of engagement with the release housing 10A (as shown in FIG. 4C).

Referring to FIG. 3, an embodiment of the initiation device as adapted to the connector assembly of the present invention is illustrated. The release housing 10A is adapted to be connected to the tubing 30. A fill sub 61 is provided for enclosing one or more firing heads 18. A firing head adapter 100 and transfer housing 110 receive the firing head 18 and connect the firing head to a balance mandrel 60. A detonating cord 115 is connected to a perforating gun 20, which is disposed on the other side of the connector assembly. The detonating cord 115 passes through the center of the connector assembly 10, and extends from the firing head 18, on one side, to the perforating gun 20, on the other side.

Figure 5:
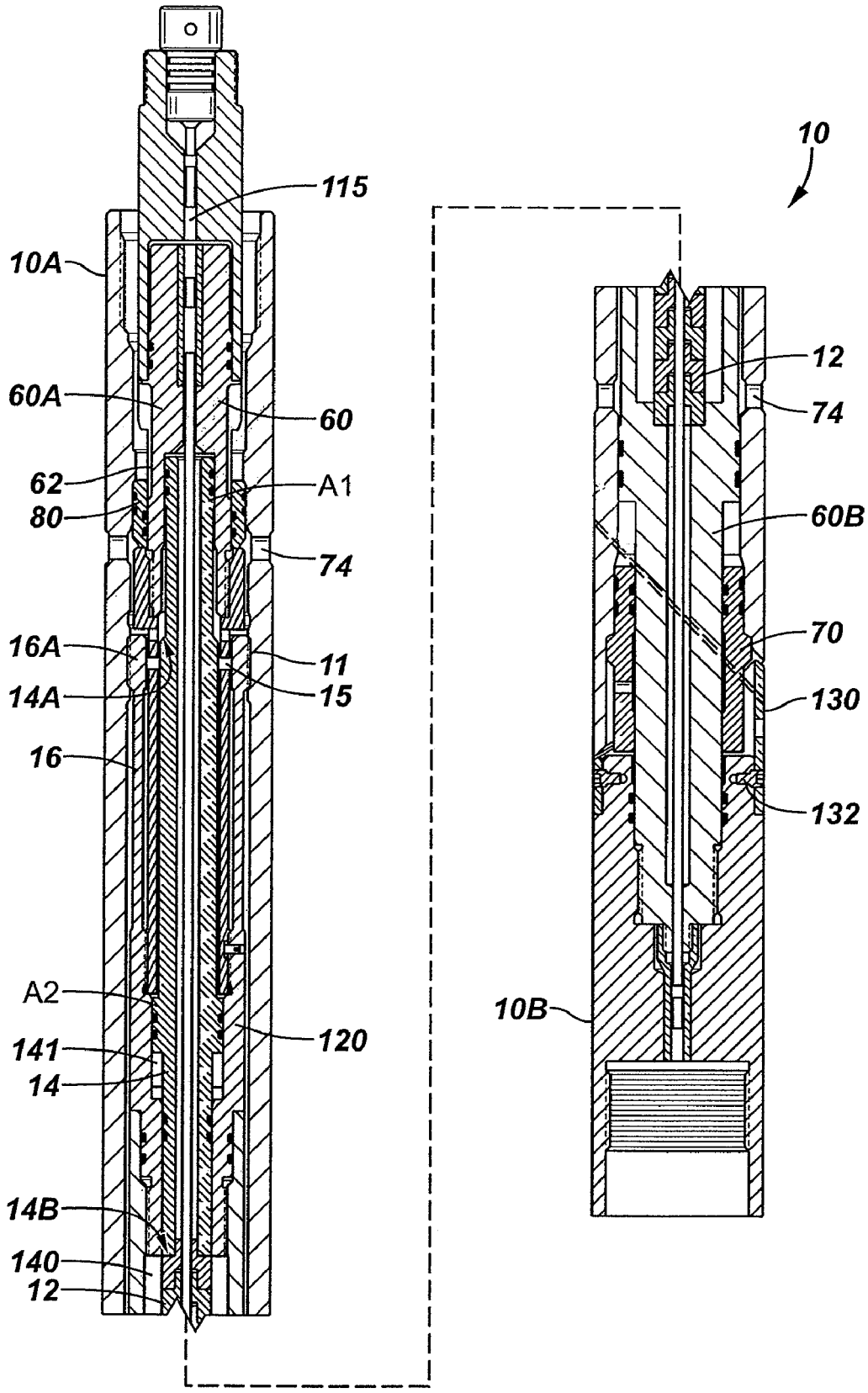
FIG. 5 illustrates an enlarged cross-sectional view of an embodiment of a connector assembly for use in releasably connecting a perforating gun to a tubing.

With respect to FIGS. 3 and 5, an embodiment of the connector assembly 10 of the present invention comprises: (1) a release piston 14 sealingly connected to the transfer housing 110, the release piston 14 having a protruded portion or locking upset 14A; (2) collet fingers 16 each having an end 16A which is adapted to contact the locking upset 14A of the release piston 14, on one side, and adapted to contact a threaded connection 111 disposed on an internal periphery of the release housing 10A, on the other side, when the end 16A contacts the locking upset 14A, the collet fingers 16 being ultimately operatively connected to the transfer housing 110 via a release collet 120; (3) a set of release pins 15 arranged between the collet fingers 16 and the release piston 14, the release pins 15 holding the collet fingers 16 radially outward into engagement with the internal periphery of the release housing 10A when adjacent to the locking upset 14A of the release piston 14; (4) a release collet 120 integrally connected to the collet fingers 16 and sealed against the release housing 10A, the release collet 120 being supported from below by the lower section 60B of the balance mandrel 60; (5) locking screws 132 for securing an anti-rotation lock 130 to the gun adapter 10B, the anti-rotation lock 130 preventing the gun adapter 10B (and thus the gun) from rotating relative to the release housing 10A; (6) a breakup plug 12 fabricated from any frangible material (e.g., ductile iron, cast iron, ceramic, and so forth) being sealingly connected to the release piston 14, one end 14B of the release piston 14 being sealingly disposed between one end of the frangible breakup plug 12 and the release collet 120, the other end of the frangible breakup plug 12 being sealingly disposed against the lower balance section 60B of a balance mandrel 60; (7) an air chamber 140 formed around the frangible breakup plug 12; (8) a balance mandrel 60 (having an upper balance section 60A and a lower balance section 60B) including one or more equalizing slots 62 formed in the upper section 60A, the balance mandrel 60 being arranged between the release piston 14 and the transfer housing 110; (9) a moveable lower piston 70 sealing beween the release housing 10A and the lower balance mandrel 60B; (10) an upper seal sleeve 80 sealing beween the release housing 10A and the upper balance mandrel 60A; and (11) a bottom sub or gun adaptor 10B operatively connected to the release collet 120 via the lower section 60B of the balance mandrel 60, the bottom sub 10B being connected to the perforating gun 20.

In FIG. 5, in some embodiments of the connector assembly 10, a wireline re-entry guide represents the actual shape of the end of the production tubing or alternatively the release housing 10A. The wireline re-entry guide is sometimes called a "muleshoe" and is shaped at an angle, having an internal bevel to provide for easy re-entry of wireline tools into the tubing after the tools have run out of the end of the tubing. The purpose of guide is to reduce the chance of hanging up wireline tools when re-entering tubing.

With reference to FIGS. 3 and 5, in operation, an embodiment of a perforating gun system in accordance with the present invention includes providing a connector assembly (as described above in various embodiments) to releasably connect a tubing 30 to a perforating gun 20. Once connected, the gun system is lowered into a wellbore to target perforating depth. Other perforating accessories, such as a packer, may be placed above the connector assembly in the wellbore. Wellbore fluid enters the release housing 10A via ports 74 and surrounds the firing head 18 and release piston 14. Hydrostatic pressure tends to force the release piston 14 downwardly into the air chamber 141, which chamber 141 is sealably formed, at one end, by the lower end of the release piston 14, which has a cross sectional area of "A2", and the inside portion of the balance mandrel 60. The upper end of the release piston 14 has a cross section area of "A1". The release piston 14 is forced downwardly by a force, which is equal to the area (A2-A1) times the hydrostatic pressure. However, initially, the release piston 14 cannot move downwardly because the frangible breakup plug 12 rigidly positions the piston 14 in place by abutting against the bottom of piston 14, on one end, and against a shoulder inside the balance mandrel 60, on the other end. The downward pressure force induced on the release piston 14 induces a downward compressive force on the frangible breakup plug 12. The frangible breakup plug 12 is designed to be stronger than any compressive force that can be induced by the release piston 14. Therefore, the release piston 14 is rigidly held in position by the frangible breakup plug 12, and the locking upset 14A of release piston 14 is positioned adjacent to the release pins 15 and the end 16A of collet finger 16; as a result, the collet fingers 16 are prevented from collapsing, and the gun adapter 10B is locked to the release housing 10A. A fluid leak in the gun string prior to initiating the firing head 18 cannot move the release piston 14 and prematurely release the perforating gun from the tubing 30 because the frangible breakup plug 12 rigidly prevents the release piston 14 from moving.

However, when the firing head 18 is initiated, a detonation wave is initiated within the detonating cord 115, the detonation wave propagating from the firing head 18, through the firing head adaptor 100, transfer housing 110, release piston 14, frangible breakup plug 12, balance mandrel 60, and gun adapter 10B, shooting the perforating gun 20. When the detonation wave propagating in the detonating cord 115 passes through the frangible breakup plug 12, the resultant shock wave and pressure from the detonation wave shatters the breakup plug 12, which is made of a frangible material that shatters in response to the shock wave from the detonating cord 115. The breakup plug 12 shatters into small pieces. As a result, the release piston 14 is no longer supported and held in position by the breakup plug 12. The pressure force pushing down on the release piston 14 forces the piston 14 down into the air chamber 140. The locking upset 14A on the release piston 14 moves out from under the end 16A of the collet fingers 16. The weight of the perforating gun connected to the gun adapter 10B causes the collet fingers 16 to collapse inwardly thereby disengaging the release collet 120 from the release housing 10A (the collet fingers 16 collapse inwardly due to the angle of the threads on the inside of the release housing 10A and the mating threads on the outside of the collet fingers 16).

Initially, the equalizing slots 62 in the upper section 60A of the balance mandrel 60 are positioned above the upper seal sleeve 80. However, as the release piston 14 begins to move axially downward, the balance mandrel 60 shifts downward such that the slots 62 uncover the inner seal of the upper seal sleeve 80. This allows the tubing pressure to balance with the wellbore pressure thus facilitating the release of the release piston 14.

When the release collet 120 is disengaged from the release housing 10A, the following equipment falls to the bottom of the wellbore: the perforating gun 20, the gun adapter 10B, the lower piston 70; the lower balance section 60B, the release collet 120 and collet fingers 16, the release piston 14, the upper seal sleeve 80, the upper balance section 60A, the transfer housing 110, the firing head adapter 100, and the fill sub 61 with the firing head 18.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A release tool adapted to be connected between a perforating gun and a tubing for releasing the perforating gun from the tubing after detonation of the perforating gun, the tool comprising:

a housing in connection with the tubing, the housing having an axial bore;

an axially shiftable member in connection between the housing and a perforating gun;

a seal member positioned in the axial bore of the housing, the axially shiftable member positioned through the seal member;

a frangible member maintaining the axially shiftable member in connection between the housing and the perforating gun until the frangible member is shatter disconnecting the shiftable member; and a means for equalizing the pressure across the seal member after the axially shiftable member is disconnected allowing the perforating gun to separate from the housing.

2. The tool of claim 1, wherein the equalizing means includes a slot formed along a portion of the axially shiftable member, wherein the pressure seal across the seal member is broken when the slot is aligned with the seal member.

3. A method of releasably connecting a perforating gun to a tubing, the method comprising the steps of:

connecting a perforating gun to a tubing via latching mechanism having a housing forming an axial bore, a seal member positioned in the axial bore, a axially shiftable member extending through the seal member and in connection with the perforating gun, and a frangible member maintaining the connection;

detonating the perforating gun and shattering the frangible member to disconnect the perforating gun from the tubing; and equalizing the pressure across the seal member to allow the perforating gun to separate from the tubing.

4. The method of claim 3, wherein the method of equalizing the pressure across the seal member, includes the steps of moving the axially shiftable member to a position aligning a slot formed on the axially shiftable member with the seal member.

* * * * *